US006786264B1

(12) United States Patent
Torres Martinez

(10) Patent No.: US 6,786,264 B1
(45) Date of Patent: Sep. 7, 2004

(54) AUTOMATIC SPLICING DEVICE FOR LAMINAR WEBS IN CONTINUOUS FEED PROCESSES

(76) Inventor: Manuel Torres Martinez, Sancho el Fuerte, 21, 31007 Pamplona (ES)

( * ) Notice: Subject to any disclaimer, the term of this patent is extended or adjusted under 35 U.S.C. 154(b) by 0 days.

(21) Appl. No.: 10/622,640

(22) Filed: Jul. 21, 2003

(30) Foreign Application Priority Data

Jul. 25, 2002 (ES) ..... 200201748

(51) Int. Cl.[7] ..... B65H 21/00

(52) U.S. Cl. ..... 156/504; 156/157; 156/159; 156/505; 156/507; 242/552; 242/553; 242/556.1

(58) Field of Search ..... 156/157, 159, 156/502, 504, 505, 507; 242/551, 552, 553, 556, 556.1

(56) References Cited

U.S. PATENT DOCUMENTS 3,841,944 A * 10/1974 Harris, Jr. ..... 156/504
5,171,396 A * 12/1992 Rank et al. ..... 156/502
5,730,389 A * 3/1998 Biagiotti ..... 242/556.1
5,975,457 A * 11/1999 Forbes ..... 242/552
6,451,145 B1 * 9/2002 Forbes ..... 156/159
2001/0035248 A1 * 11/2001 Sato et al. ..... 156/64

FOREIGN PATENT DOCUMENTS

| | | |
|---|---|---|
| ES | 484 893 | 10/1979 |
| ES | 2 005 866 | 4/1989 |
| ES | 8901533 | 5/1989 |
| ES | 200002233 | 9/2000 |
| ES | 200002234 | 9/2000 |
| ES | 200002235 | 9/2000 |
| ES | 1 193 200 | 4/2002 |

* cited by examiner

*Primary Examiner*—Mark A. Osele
(74) *Attorney, Agent, or Firm*—Nath & Associates PLLC; Gary M. Nath

(57) ABSTRACT

Automatic splicing device for laminar webs in continuous feed processes, consisting of two reel-carriers (1 and 2), mounted above which are the respective preparation heads (3 and 4) and between them a moving head (14) capable of displacement between the positions of said preparation heads (3 and 4), for the preparation in either of these of the web from a reel in stand-by for the subsequent joining to the web of another infeed reel when the latter runs out, without any interruption to the feed process.

4 Claims, 10 Drawing Sheets

AUTOMATIC SPLICING DEVICE FOR LAMINAR WEBS IN CONTINUOUS FEED PROCESSES

The present invention refers to a splicing device for laminar webs, designed for the automatic joining of webs that are supplied continuously to application processes.

In the processes involving the feeding of laminar webs, for example in the formation of corrugated board or in other applications of a similar nature, in order to ensure the continuity of the feed without having to interrupt the process, at least two reels containing the material to be supplied are provided, so that whilst the material is supplied by one of the reels, the other reel is ready in stand-by, so that when the reel currently providing the supply runs out, the supply is then provided by the reel that is in stand-by.

In order not to have to halt the process during the changeover of the supply reels, splicing mechanisms have been developed, in order to perform an automatic splicing between the end of the spent reel and the leading edge of the reel in stand-by, such as, for example, the solutions covered by Spanish Patent 484,893 and Patent 200002234, amongst others, by the same holder of the present invention.

Said splicing mechanisms perform the join by adhesion between the end of the web of the reel that is running out and the leading edge of the web of the reel that is in stand-by, cutting any excess off the finished web, in a manner whereby as of that moment the web continues to be supplied from the second reel, whilst in the place of the spent reel another reel can be mounted and made ready in stand-by to be subsequently joined, in the same way, to the infeed web when the infeed reel runs out. Accordingly, the aforementioned splicing devices consist of two reel-carriers, upon which respective structures are mounted in a travelling carriage, through one of which the infeed web passes, whilst in the other preparation is made of the web that is to remain in stand-by, with the aforementioned structures provided with devices that allow for the sticking and cutting of the two webs for the continuance of the feed when the supply reel runs out.

Existing splicing devices nevertheless feature deficiencies in terms of the precision and accuracy of their operation, allowing for the possibility of a faulty join in the webs that may affect the application process and/or the result of this application.

In that sense, in accordance with the present invention, a splicing device is proposed that is fitted with means of operation and structural features that permit the splicing of the webs to be effected both precisely and accurately, removing any possible defect that may compromise the application process or the condition of the corresponding end product.

The splicing device that is covered by this invention consists of respective preparation heads above the respective reel-carriers and between them a moving head that may be displaced between the positions of the aforementioned preparation heads, with each of these preparation heads including a fixed roller, upon whose shaft a tilting system is fitted and operated by a pneumatic cylinder, which comprises at one end a preparation section and, at the other end, a roller sheathed in an elastic material, with regard to whose shaft an attachment section is fitted, which may tilt operated by a pneumatic cylinder.

The preparation cylinder is fitted with a vacuum system for holding the end of the web to be prepared, furthermore incorporating a cutting mechanism for transversally cutting off said leading edge of the web to be prepared.

The moving head consists of two rollers fitted with a pneumatic brake and radially driven by respective pneumatic cylinders, as well as by respective cutting systems, also operated by pneumatic actuators, and a bar that incorporates a vacuum holding system.

The splicing device is integrated with a tension unit on the web being fed, consisting of a hollow drive roller with a vacuum system for holding the web to it; with there also being a group of moving rollers above the splicing device unit which constitute a return loop of variable length through which the infeed web passes.

This therefore provides a unit that allows for the web to be fed to the corresponding application from a supply reel placed on one of the reel-carriers, while the web on the other reel that is to remain in stand-by is being prepared, so that when the infeed reel runs out, automatically and by means of a functional actuation procedure between the moving head and the preparation head that corresponds to the web in stand-by, the web in stand-by and that being fed are joined automatically and the latter is cut off.

The process is undertaken in conjunction with the operation of the tension unit on the web being supplied and of the return loop of variable length, in a manner whereby the splicing between the two webs is effected quickly and with the utmost accuracy, maintaining the continuity of the supply of web to the application process.

In view of the above, the splicing device described provides significant operational advantages in the application for which it is designed, and in particular:

- It allows for a straightforward and rapid preparation sequence for the splicing of the webs.
- It allows for the splicing to be performed at high speed, fully exhausting the reel that is running out, for which the geometry of the threading of the web through the splicing device maximises the distance between the reel that supplies the web and the point where the splicing is performed, furthermore employing a vacuum system that holds the supply web and allows it to be fed at the same time, with action on a point immediately prior to the join.
- It allows for the supply of the web at constant tension during the unwinding process and even during the sequences of acceleration, deceleration and splicing, thanks to a drive roller operated by means of an electric motor that is controlled by a speed regulator and a vacuum system that exerts a force which holds the paper against the drive roller, but which enables the web supplied to be fed.

FIG. 1 schematically depicts a lateral elevation view of a splicing device in accordance with the invention.

FIG. 6 is a side view of the splicing device during the displacement stage of the travelling carriage for the joining of the web from the supply reel to the web from the reel in stand-by.

FIGS. 7, 8, 9, 10, 11 and 12 show, in successive positions, the joining sequence between the infeed web and the web in stand-by.

The subject of the invention consists in an automatic splicing device for the joining of laminar webs in continuous feed processes, for the purpose of joining the extreme end of the supply reel, when it is spent, to the leading edge of a fresh reel in order to continue the supply.

Figure 1:
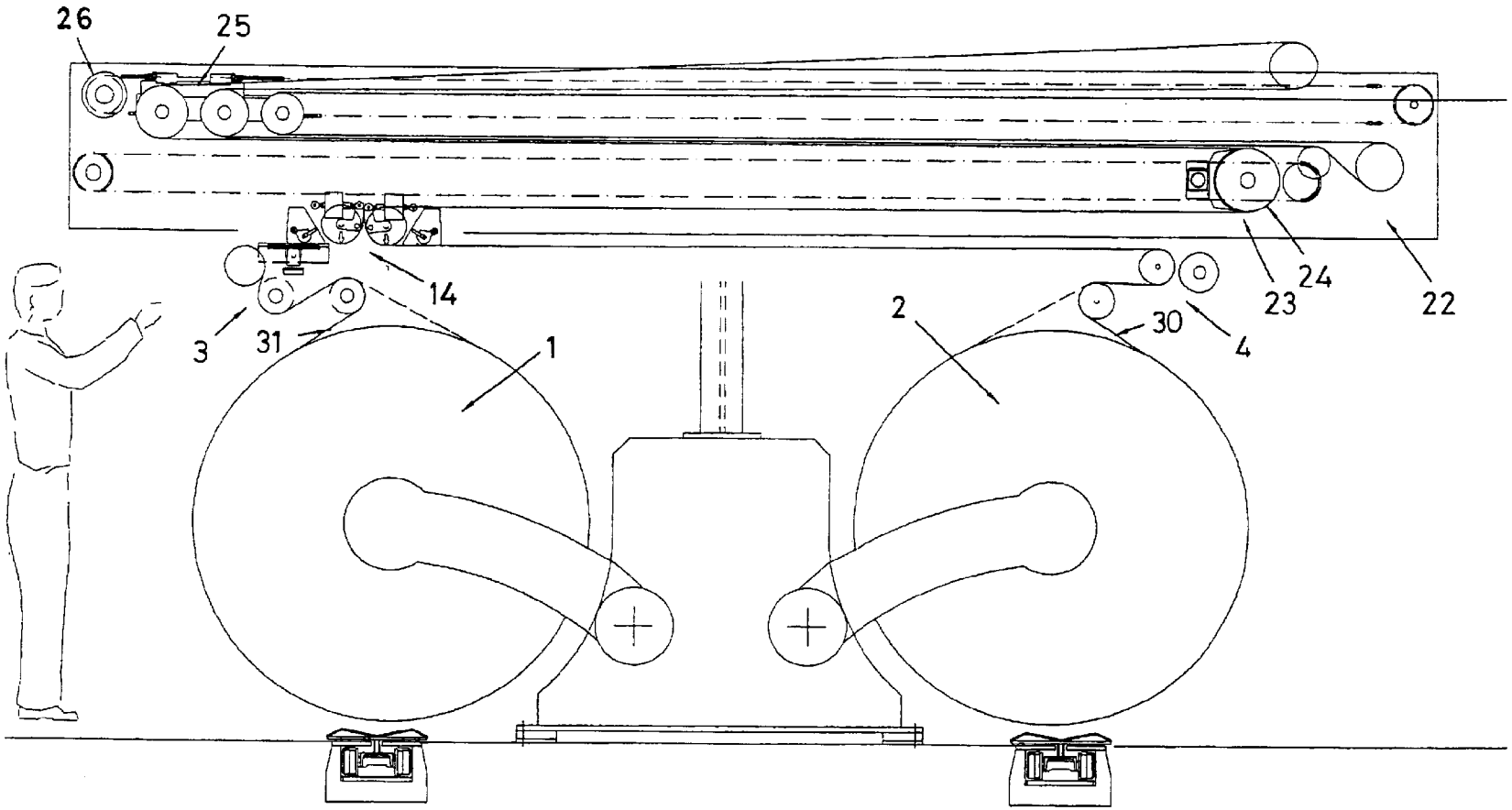
Figure 2:
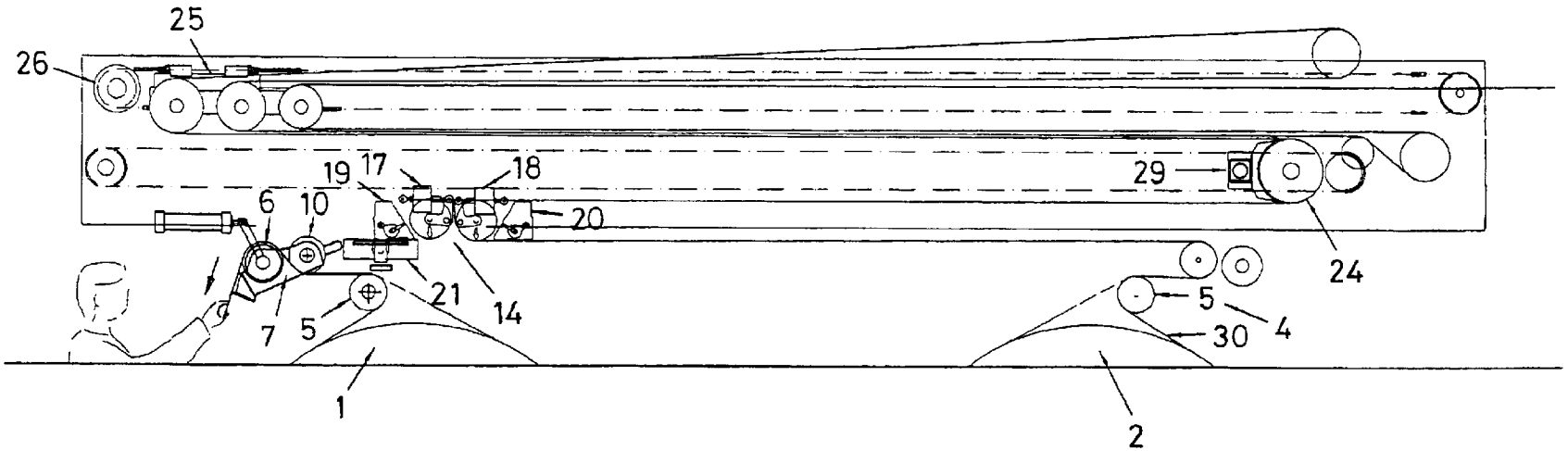
FIG. 2 is a more detailed side view of the upper part of the splicing device.

According to the embodiment illustrated in FIG. 1, the splicing device consists of two reel-carriers, designed for the mounting of respective reels (1 and 2), one of which supplies the infeed web to the application process, whilst the other is maintained in stand-by in a manner whereby when the supply reel runs out the join can be effected of the web on the same to the web on the other reel ready in stand-by.

Above the position of each one of the reels (1 and 2) there are respective heads (3 and 4) for the preparation of the webs, each one of which consists of a parallel structure formed by a fixed roller (5), designed to facilitate the feed of the corresponding web at the outlet of the respective reel (1 or 2), another fixed roller (6) and a tilting structure (7) mounted on the same shaft as the roller (6) but independent of the same.

The tilting structure (7) is operated by a pneumatic cylinder (8) and is fitted at one end with a section (9) parallel to the roller (6), whilst at the other end there is a roller (10) with its outside sheathed in a synthetic material; there is a section (11) incorporated in a tilting arrangement on the shaft of said roller (10) in parallel to the same, which may rotate independently of said roller (10), being operated by means of a respective pneumatic cylinder (12).

The section (9) incorporates a vacuum system for holding onto it the web that is to be prepared; it is fitted at the front with a groove (13), along which a blade will slide in order to cut off the end of the web in preparation.

Between the two preparation heads (3 and 4) there is a moving head (14), which is capable of horizontal displacement between the positions of both preparation heads (3 and 4).

Said moving head (14) consists of two moving rollers (15 and 16), which are capable of a certain degree of vertical movement, by means of respective pneumatic cylinders (17 and 18), with this head (4) furthermore fitted with respective cutting devices (19 and 20), operated in turn by their corresponding pneumatic actuators; mounted below the aforementioned assembly is a bar (21) that incorporates a vacuum holding system, above which bar the entire aforesaid unit of rollers (15 and 16) and cutting devices (19 and 20) can be displaced. The rollers (15 and 16) are also fitted with a pneumatic brake.

On the upper part of the splicing device there is an assembly (22) which includes a tension unit (23) which comprises a drive roller (24), through which the web that is supplied to the application process is fed, with said assembly (22) furthermore fitted with a unit of rollers (25), which may vary in number, which may be displaced horizontally by means of an electric motor and a pneumatic clutch (26), forming a return loop of variable length of feed of the supply web from the roller (24) on the tensor (23) toward the application process.

Figure 15:
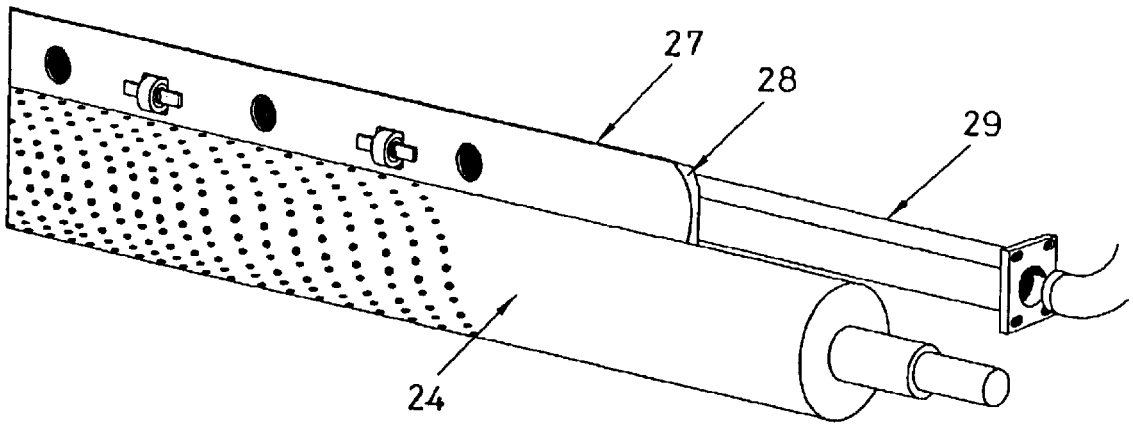
FIG. 15 is a frontal perspective view of the extreme end of the drive roller of the tension unit of the web being supplied, in the part where the vacuum system is connected.
Figure 16:
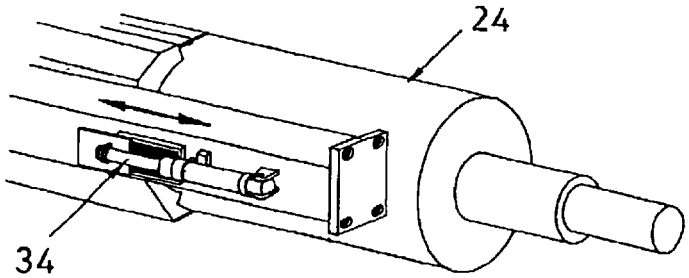
FIG. 16 is a detailed view from the rear of the other end of the drive roller of the tension unit.
Figure 17:
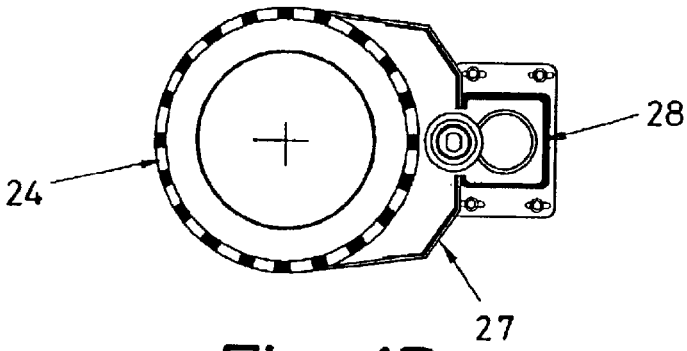
FIG. 17 is a diagram of the cross-section of the aforementioned drive roller of the tension unit with the hood that partially encloses the outer part of the same.

The roller (24) is hollow and perforated by means of through holes covering the greater part of its surface, as is observed in FIGS. 15 to 17, being arranged in such a manner that the infeed web enters into contact with approximately half of its outer surface.

In view of the fact that to create a vacuum force on said roller (24) which enables the web that passes over it to be held, it is necessary to effect the airtight sealing of all the holes on the periphery of the same, therefore on that part not in contact with the web there is a semi-cylindrical hood (27), fitted with flexible edges (28), which when coming into contact with the roller (24) seals that part of the outer surface of the same that is not in contact with the web, thus ensuring the sealing of the surface of the roller (24), even at high speeds, so that the vacuum will effectively permit the holding of the web. The hood (27) is fitted with a hollow section (29) which is connected to a vacuum turbine, which removes the air to create the vacuum in the roller (24).

In view of all the above, considering that the infeed web (30) comes from the reel (2), running through the preparation head (4) and through the moving head (14), to leave through the tensor (23), and through the rollers (29) of the variable return loop, towards the application process, and that the other reel-carrier holds a reel (1), whose web (31) is arranged to remain in stand-by on the respective preparation head (3), the preparation sequence is as follows:

Whilst the web (30) is being fed, the web (31) may run through the rollers (5, 10 and 6) of the preparation head (3), until the leading edge of the same rests on the section (9).

Figure 3:
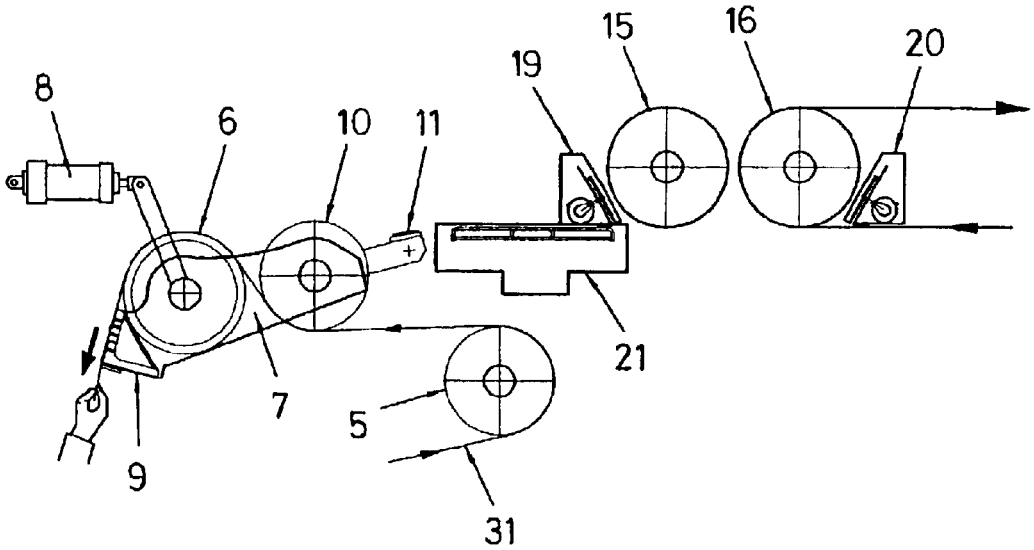
FIGS. 3, 4 and 5 illustrate, in successive positions, the sequence for the preparation of the leading edge of a web on the corresponding preparation head.
Figure 4:
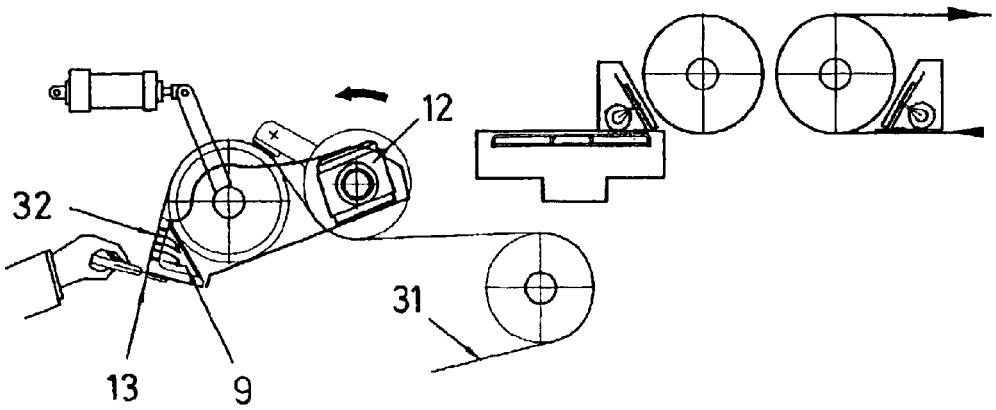

Once the leading edge of the web (31) is on the section (9), any excess on said leading edge is cut off manually, as shown in FIGS. 3 and 4. Once this has been done, a double-sided adhesive tape (32) is applied to the portion of the web (31) that remains on the face of the section (9), with this extreme end of the web (31) remaining fixed onto the section (9), thanks to the latter's vacuum system.

Figure 5:
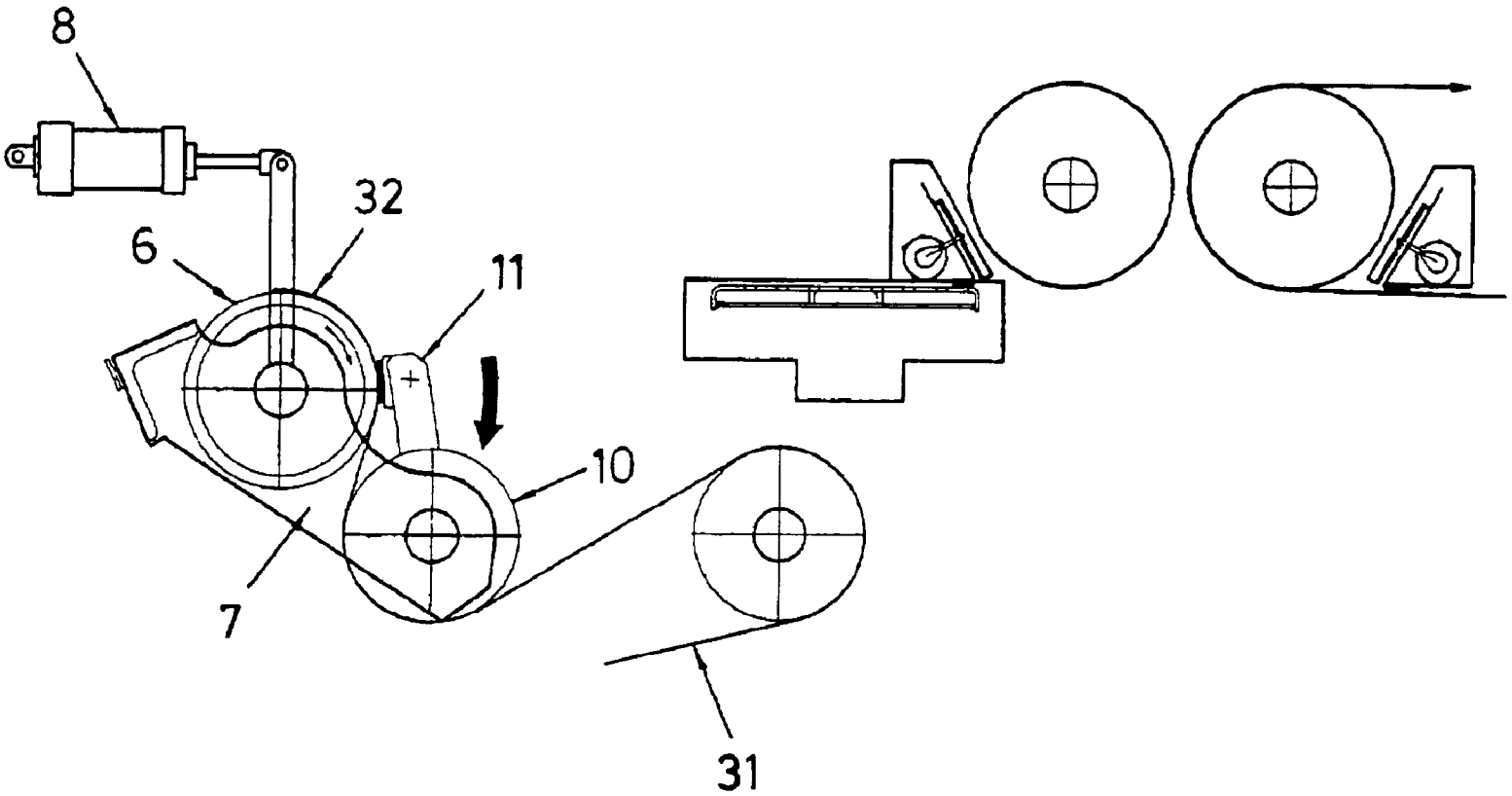

In the next stage, by means of the operation of a control button by the operator, a pneumatic cylinder (8) is activated, which makes the whole structure (7) tilt up to an adjustable stop so that the leading edge of the web (31) with the adhesive tape (32) remains in a pre-set position on the roller (6), as shown in FIG. 5.

Figure 6:
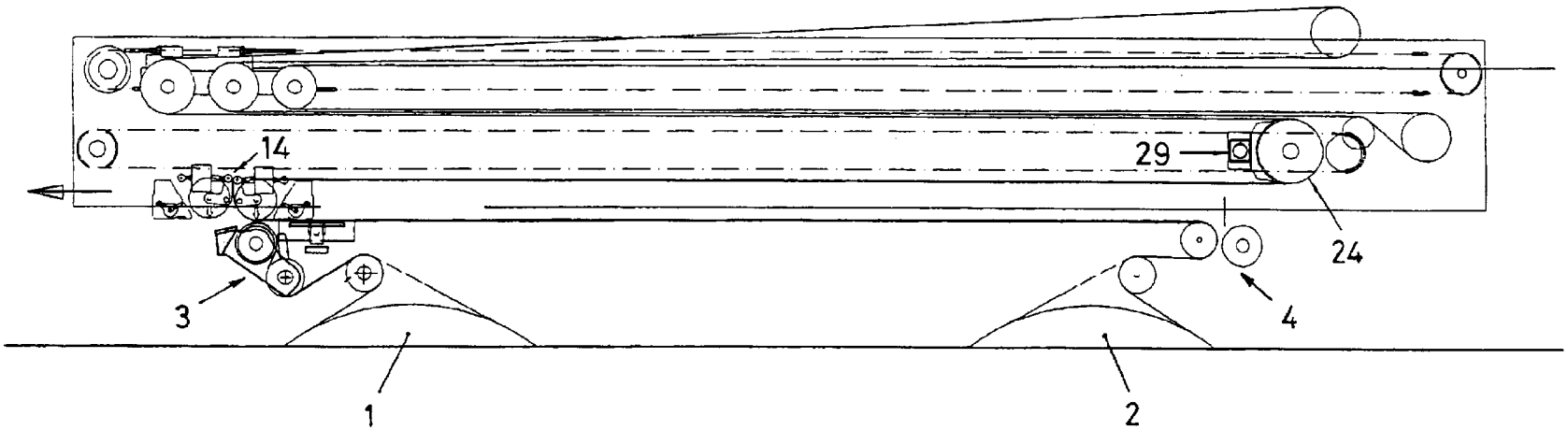
Figure 7:
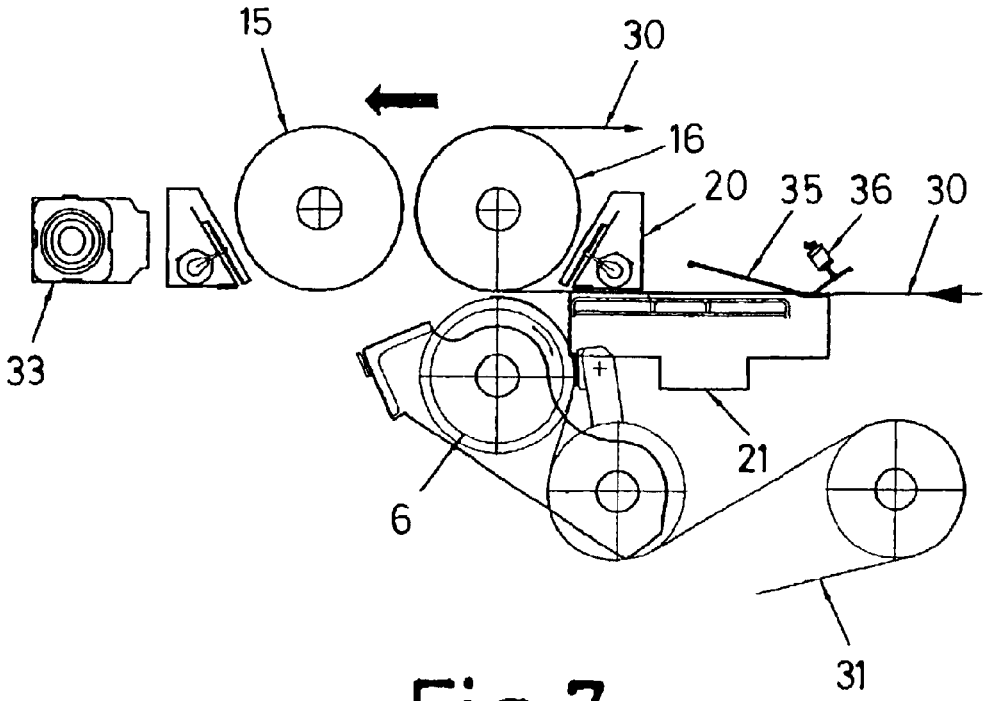

Thereupon, and in an automatic manner, the moving head (14) moves into a pre-set splicing position, as shown in FIG. 6, with the ensuing activation of a pneumatic cylinder (33) to immobilise it in that position, where the two rollers (16 and 6) are vertically facing each other, as illustrated in FIG. 7.

Once this state has been achieved, the splicing device is ready to perform the splicing sequence between the webs (30 and 31), which may be activated manually or automatically when the reel (2) runs out.

Figure 8:
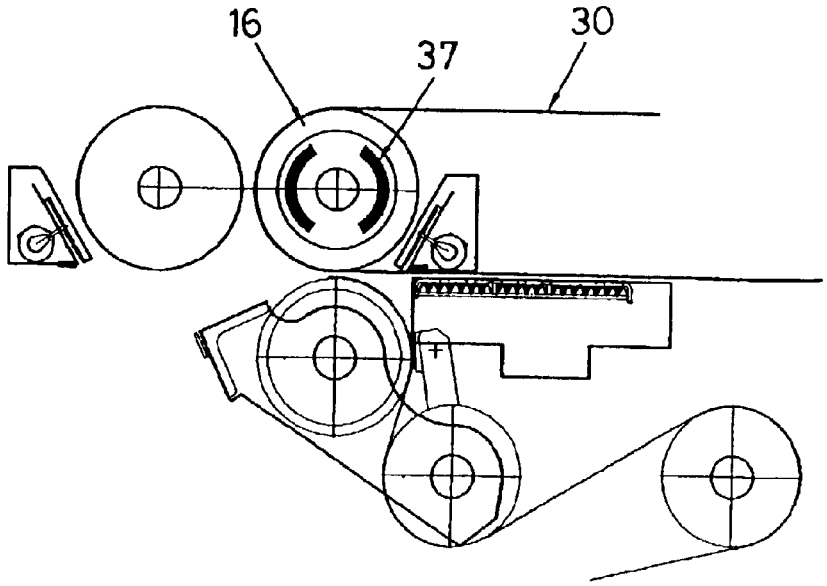

In the case of automatic splicing, when there remains a pre-set number of metres for the end of the web (30) on the reel (2), the turbine that creates the vacuum is operated and by means of a pneumatic cylinder (34) a window opens in the vacuum link to the bar (21), creating a low level vacuum pressure, by means of which the infeed web (30) is held onto said bar (21), as shown in FIG. 8.

At the same time a strip (35) is pivoted by means of a pneumatic cylinder (36) in order to ensure that the infeed web (30) rests on the bar (21), for the purpose of ensuring that the web (30) is held by the vacuum.

Finally, a vacuum is also applied to the drive roller (24) of the tensor (23), which rotates at a controlled speed to compensate for the force of the braking applied to the web (30) by the vacuum applied to the bar (21).

When the web (30) reaches the end, the system detects this and then, by means of the pneumatic cylinder (34), the window of the vacuum link to the bar (21) closes, whereby the maximum vacuum pressure is applied in it, whereas the drive roller (24) is left without a vacuum. At this stage, a braking action is applied to the drive roller (24) and by means of the corresponding pneumatic brake (25) the roller (16) is brought to a halt, which leads to the almost complete stoppage of the infeed web (30).

Figure 9:
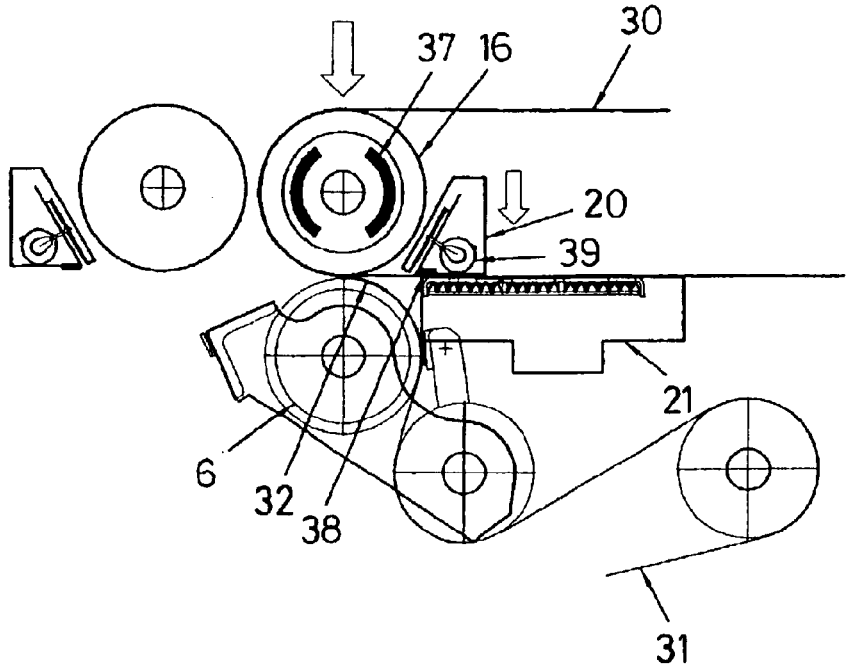

Subsequently, by means of the pneumatic cylinder (18), the cutting device (20) is lowered onto the bar (21), with said device (20) firmly holding, by means of an elastic pad (38), the infeed web (30) against the bar (21), as shown in FIG. 9, thus ensuring the full stoppage of the web (30) if this had not been fully achieved beforehand.

Figure 10:
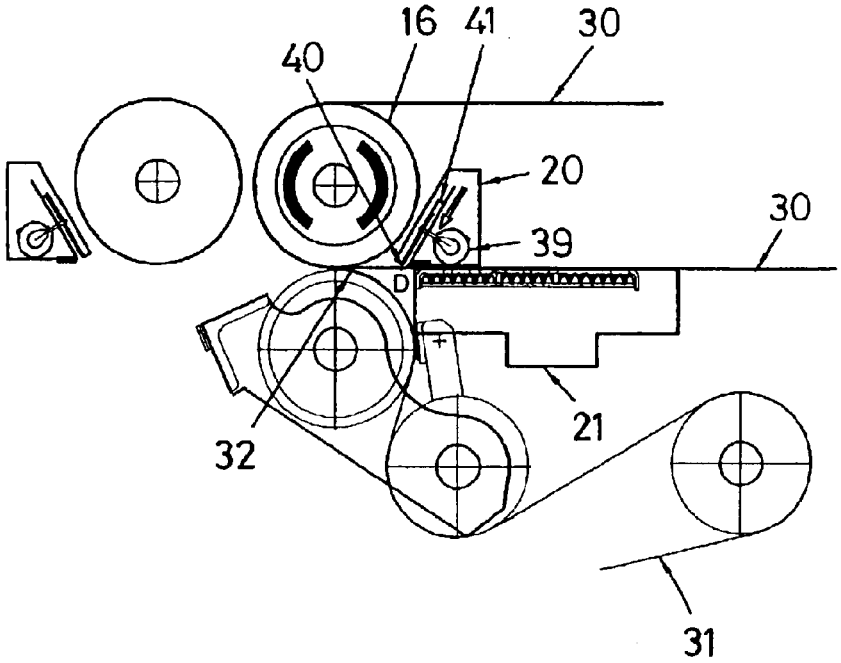

By means of the same action of the pneumatic cylinder (18), the roller (16) impacts against the roller (6), so producing the joining of the webs (30 and 31) by means of the adhesive tape (32). Subsequently, by means of the corresponding pneumatic actuator (39), the blade (40) that is located in the section (41) of the cutting device (20) is operated, as illustrated in FIG. 10. At the same time, a vacuum is applied to the drive roller (24), leaving the bar (21) without a vacuum.

Figure 11:
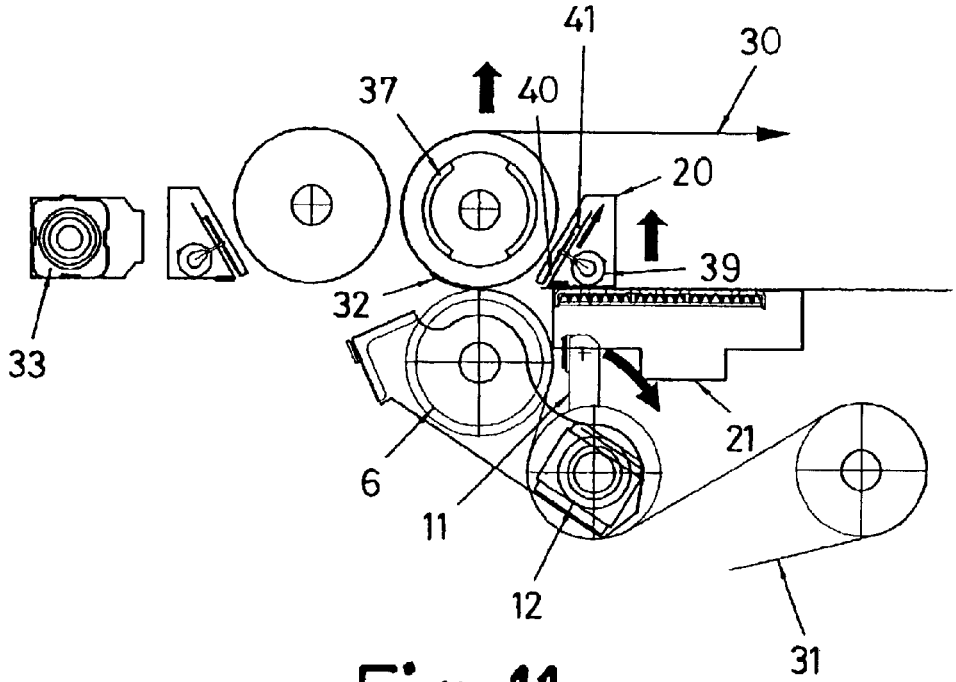

Once the web (30) has been cut, the blade (40) is withdrawn by means of the return action of the pneumatic actuator (39) and the pneumatic brake (37) of the roller (16) is released. Subsequently, the drive roller (24) begins to rotate, helping to displace the joined webs (30 and 31), through the rollers (16 and 6), that continue to press up against each other; as these rollers rotate, they ensure the total action of the adhesive tape (32) on the webs (30 and 31), as illustrated in FIG. 11.

Figure 12:
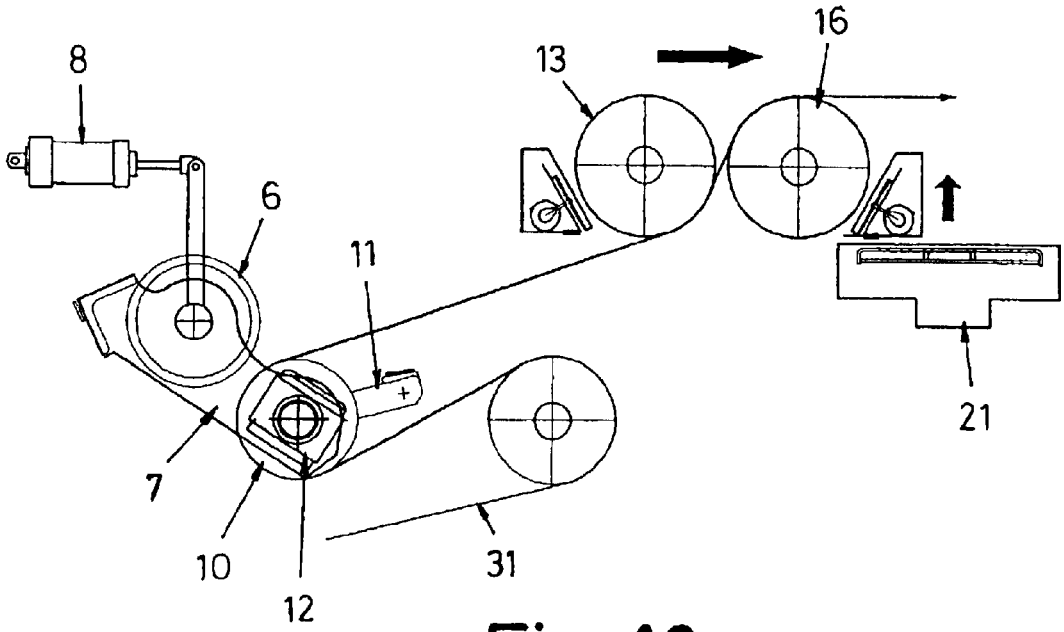
Figure 13:
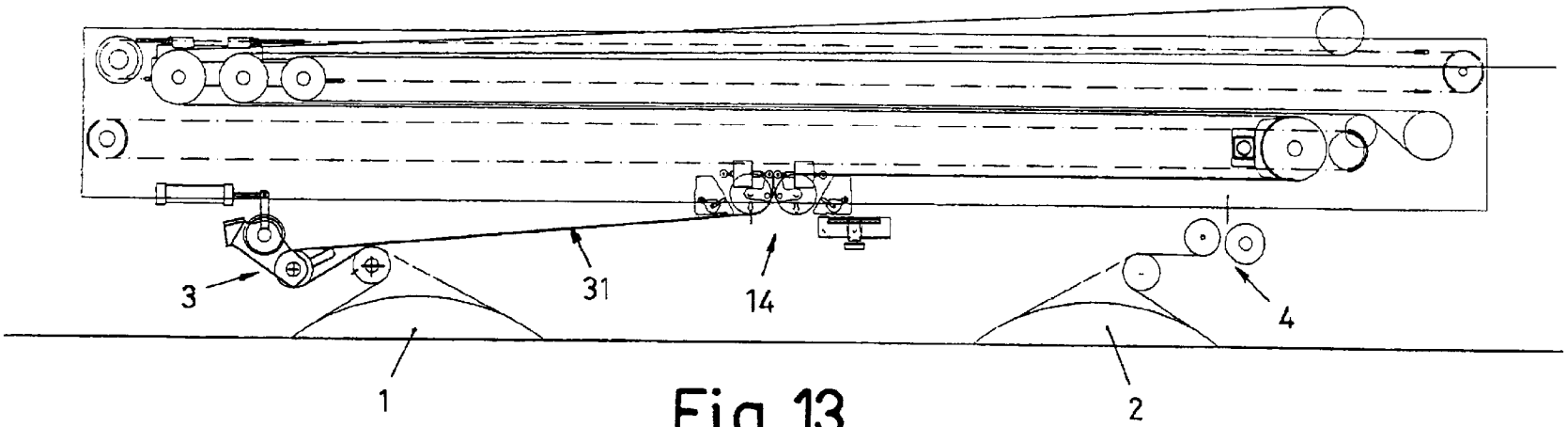
FIG. 13 is a side view of the upper part of the splicing device during the stage involving the displacement of the travelling carriage from the part in which the splicing of the webs has been effected towards the opposite part.
Figure 14:
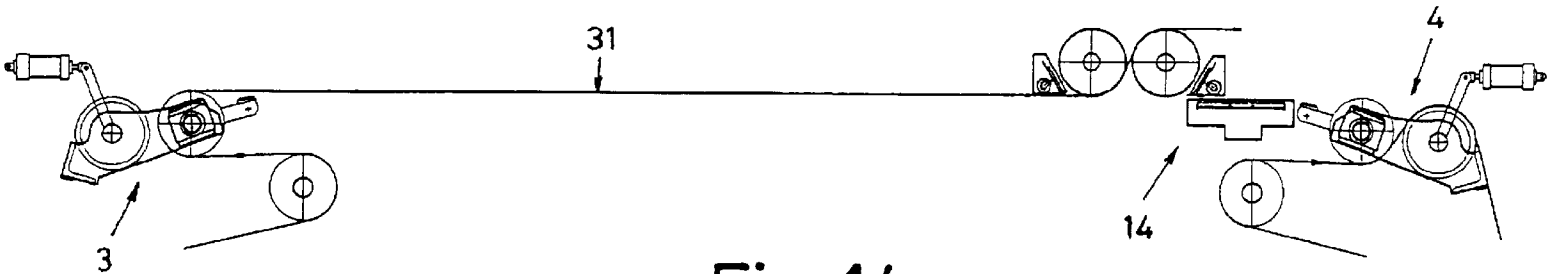
FIG. 14 is a diagram of the arrangement of the heads in the preparation position of another web supplied by a fresh reel in the position where the previous one had run out.

Finally, the pneumatic cylinder (18) is operated which raises the roller (16) and at the same time the pneumatic cylinder (12) is operated, which withdraws the section (11) that was holding the prepared web (31) against the roller (6), whereby, as shown in FIG. 12, said web (31) remains free to progress joined to the web (30). At that moment the drive roller (24) begins to accelerate following a pre-set gradient, until it reaches process speed, with the vacuum being upheld at its maximum level on said roller (24), in order to avoid the sliding of the web on the same during acceleration. The moving head (14) is meanwhile displaced to the position of the preparation head, as shown in FIGS. 13 and 14, leaving the splicing device ready for the incorporation and preparation of a new reel in replacement of the spent reel (2).

What is claimed is:

1. An automatic splicing device for laminar webs in continuous feed processes, of the type consisting of two reel-carriers, upon which incorporation is made of respective reels (1 and 2), from one of which the infeed web (30) is supplied to the application process, whilst the other is arranged with its web (31) in stand-by to be joined to the infeed web (30) when the corresponding reel runs out, characterised in that mounted above the respective reel-carriers there are respective preparation heads (3 and 4) and between these there is a moving head (14), capable of moving between the positions of said preparation heads (3 and 4), with each of these preparation heads (3 and 4) comprising a fixed roller (6), upon the shaft of which a tilting structure (7) is fitted that is operated by a pneumatic cylinder (8), which structure is fitted at one end with a section (9) for deploying the edge of the web (31) arranged to remain in stand-by, whilst at the other end of said structure (7) there is a roller (10) sheathed in elastic material, upon the shaft of which there is a section (11) that can tilt independently to grip the web (31) against the roller (6).

2. An automatic splicing device for laminar webs in continuous feed processes, all in accordance with claim 1, characterised in that the moving head (14) consists of two parallel rollers (15 and 16), respective cutting systems (19 and 20) and a bar (21) formed by a hollow section that incorporates a vacuum holding system, with the assembly of the rollers (15 and 16) and of the cutting systems (19 and 20) being arranged in horizontal displacement above the bar (21), whilst each one of the rollers (15 and 16) and each one of the cutting systems (19 and 20) can be displaced vertically, in order to rest, respectively, on the roller (6) and on the bar (21), with the rollers (15 and 16) being fitted with a pneumatic brake (37) to halt their rotary movement.

3. An automatic splicing device for laminar webs in continuous feed processes, all in accordance with claim 1, characterised in that the supply of the infeed web (30) to the application system is established through a tensor unit (23), which consists of a drive roller (24) that incorporates a vacuum system for holding the web (30) feeding over it.

4. An automatic splicing device for laminar webs in continuous feed processes, all in accordance with claim 3, characterised in that the drive roller (24) is hollow and features a perforated outer surface, with a semi-cylindrical hood (27) being arranged in relation to it, which rests on the roller (24) with flexible edges (28), producing an airtight seal on the area of the outer surface where the infeed web (30) does not come into contact, for the application, by means of said hood (27), of a vacuum for holding the infeed web (30) against the roller (24) with freedom of the same to progress.

* * * * *